United States Patent [19]

Boxer

[11] Patent Number: 4,760,227

[45] Date of Patent: Jul. 26, 1988

[54] SLIDING SWITCH COVER

[75] Inventor: Jay I. Boxer, New York City, N.Y.

[73] Assignee: Interior Techniques, Ltd., New York, N.Y.

[21] Appl. No.: 925,714

[22] Filed: Oct. 30, 1986

[51] Int. Cl.[4] ..... H01H 9/00

[52] U.S. Cl. ..... 200/330; 200/338

[58] Field of Search ..... 384/42; 74/503, 544, 74/491, 110; 200/330, 331, 333, 338; 29/622

[56] References Cited

U.S. PATENT DOCUMENTS

| | | | |
|---|---|---|---|
| 2,172,731 | 9/1939 | Coles | 200/330 X |
| 2,354,224 | 7/1944 | Stein | 200/331 X |
| 2,382,738 | 8/1945 | Moyses | 200/330 |
| 2,389,220 | 11/1945 | Tredeau | 200/331 |
| 2,571,837 | 10/1951 | Coles | 200/331 |
| 2,668,456 | 2/1954 | Meistrell | 200/331 X |
| 2,712,582 | 7/1955 | Peretti | 200/331 |
| 3,077,789 | 2/1963 | Lashmutt | 200/331 |
| 3,350,143 | 10/1967 | Lichowsky | 384/42 |
| 3,816,686 | 6/1974 | Boddet et al. | 200/330 |
| 3,839,615 | 10/1974 | Bradford | 200/331 |
| 3,892,935 | 7/1975 | Patterson | 200/331 |
| 4,105,884 | 8/1978 | Damsky | 200/331 |
| 4,295,026 | 10/1981 | Williams et al. | 200/331 |
| 4,427,864 | 1/1984 | Oster | 200/330 |
| 4,454,401 | 6/1984 | Powis, Jr. | 200/331 |

*Primary Examiner*—Henry J. Recla
*Assistant Examiner*—Ernest G. Cusick
*Attorney, Agent, or Firm*—Hedman, Gibson Costigan & Hoare

[57] ABSTRACT

A sliding switch cover assembly which comprises a switch plate on which a toggle actuator is mounted by two sets of vertically aligned pins extending from the switch plate, vertical slots in the actuator in alignment with the two sets of vertically aligned pins and a means to retain the slots on the pins for sliding movement of the actuator on the pins. The actuator can comprise a two-piece assembly pins. The actuator can comprise a two-piece assembly comprising an actuator back plate which contacts the pins on the switch plate and an actuator element which attaches to the actuator back plate.

5 Claims, 2 Drawing Sheets

FIG. 1
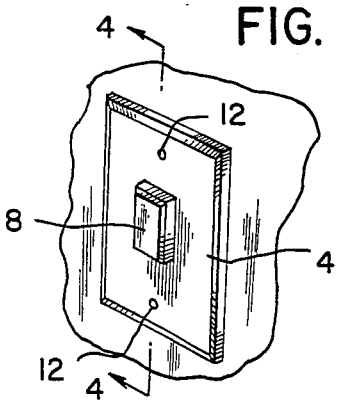
FIG. 2
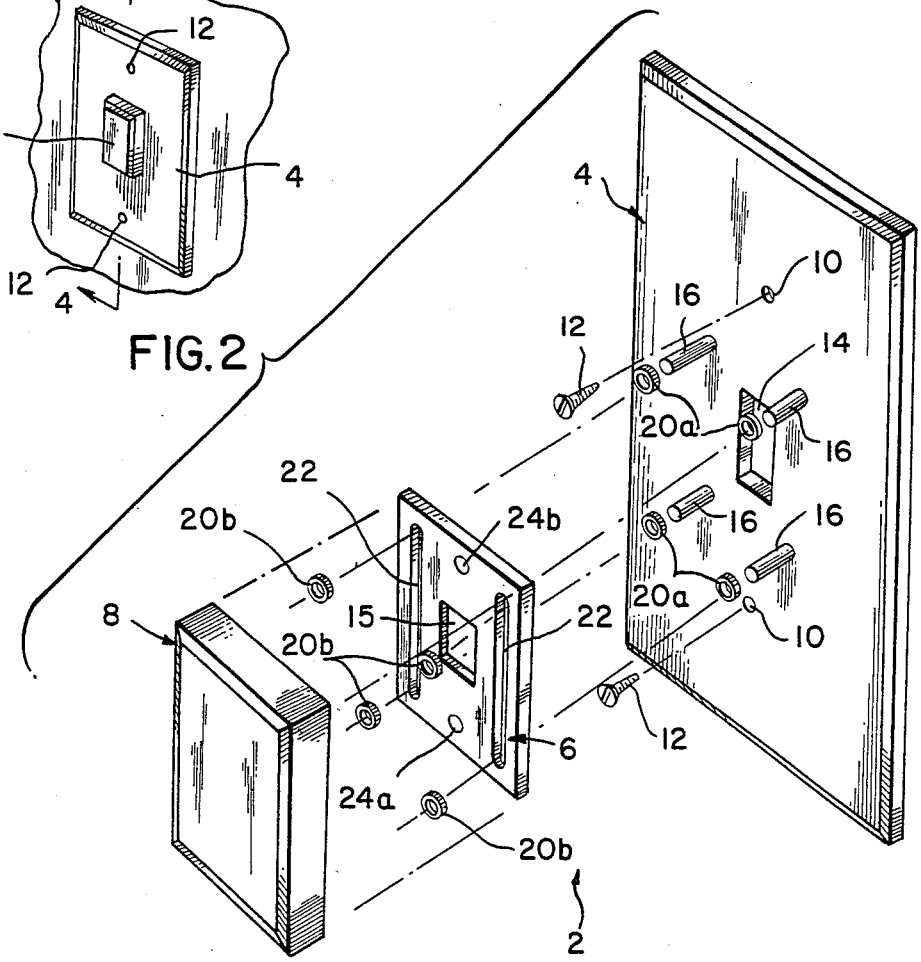
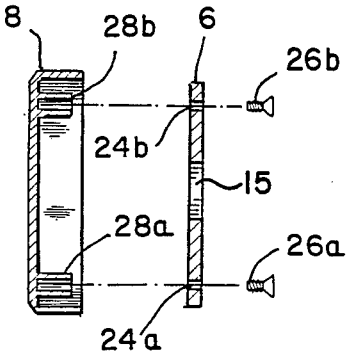
FIG. 3
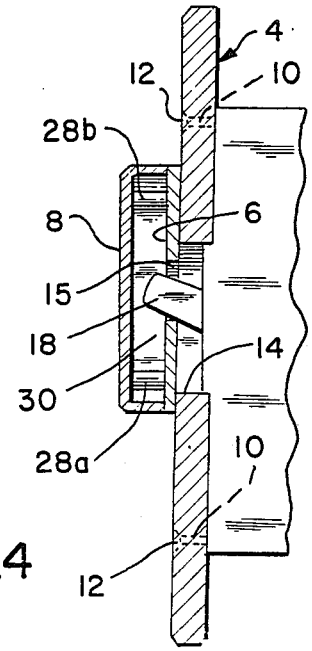
FIG. 4

SLIDING SWITCH COVER

FIELD OF THE INVENTION

This invention relates to Switch Plates for electrical wall switches. More paricularly, the invention relates to a switch plate that can cooperate with a conventional wall toggle switch, protect the toggle and mount a decorative switch trip.

BACKGROUND OF THE INVENTION

Electrical toggle switches have long been used to open and close the circuit to an electrical light from a remote location. Typically the electrical toggle switch is located on the wall near the entrance of a room and is arranged in a circuit, the conductors of which extend to an outlet at a location in the room remote from the switch. An electrical lamp is usually plugged into the outlet and controlled by the switch.

Recently, decorative switch plates have become popular. The decorative switch plates customarily are provided with cartoon characters painted or embossed on the switch plate. However, the conventional rectangular opening is provided through which the toggle switch extends for vertical travel to facilitate opening and closing of the circuit by actuation of the toggle switch.

SUMMARY OF THE INVENTION

It is an object of this invention to provide a wall switch plate to cover and cooperate with a conventional electrical toggle switch.

It is a further object of this invention to provide a wall switch plate that fully shields the toggle actuator from access by anyone actuating the switch.

A still further object of the invention is to provide a switch plate for use with an electrical wall toggle that can mount a decorative actuator over the toggle actuator and conventional opening through which the toggle actuator extends.

It is a still further object of the invention to provide a wall switch plate adapted to releasably mount a decorative actuator thereby affording the capacity to mount various decorative actuators.

Another object of the present invention is to provide a switch plate having a rear surface that is flush with the wall and which thereby seals the opening for the toggle switch from cold air currents generated within the outside walls of a building.

The foregoing objects and other objects inherent from the following disclosure are accomplished by the present invention and use thereof.

The invention in its broadest aspect comprises a device for actuating an electrical circuit through the use of a conventional electrical toggle switch which is protective of the wall opening and the toggle switch while presenting a decorative image.

Protection of the wall opening is achieved through the use of a facing plate designed to fit flush with the wall over a wall opening containing an electrical toggle switch. The size of the face plate to be at least the size of the wall opening for the toggle switch and possibly any size or shape which at least covers the wall opening. The face plate has holes to correspond to the threaded holes in ordinary electrical toggle switches for cover plate mounting and a center opening for the toggle switch. The center opening is sufficient to allow vertical on/off throw of the toggle switch as well as a vertical length sufficient to allow screwdriver access to threaded bushing on the actuator element. The face plate further has means for attaching the vertically movable actuator element and actuator back plate which physically contacts the toggle switch to allow actuation of the switch.

Protection of the toggle switch is maintained by the actuation element which moves vertically on the face plate to allow on/off actuation of a conventional toggle switch. The toggle switch actuator has an opening in the back plate to allow extension of the toggle switch and surfaces of the opening to physically contact the toggle switch for on/off actuation. The actuator further has a recess to allow the toggle switch extention and vertical throw within the actuator. The actuator is removable and interchangeable with other movable actuators of varying design to match any decor.

The present invention can be expanded to provide a face plate with multiple openings corresponding to multiple toggle switches controlling various independant circuits. In this event, multiple acuator elements will be fitted to the face plate and individual toggle switches in accordance with the foregoing.

BRIEF DESCRIPTION OF THE DRAWINGS

The invention will be more readily understood when viewed with the following drawings wherein:

FIG. 1 is a perspective view of the assembled switch plate of the subject invention;

FIG. 2 is an exploded view of the switch plate of the present invention;

FIG. 3 is a side elevational view of the unassembled actuator element and actuator backing plate of the subject invention;

FIG. 4 is a side elevational sectional view of the present invention taken through line 4—4 of FIG. 1;

DESCRIPTION OF THE PREFERRED EMBODIMENT

The present invention is described in an embodiment depicting a single square decorative actuation element as shown in FIG. 1, however, it is clear that the actuation element of the subject invention can take any form, including the image of a cartoon character such as HULK HOGAN, or provide multiple actuation elements for use on a multiple toggle switch face plate controlling multiple circuits.

Figure 8:
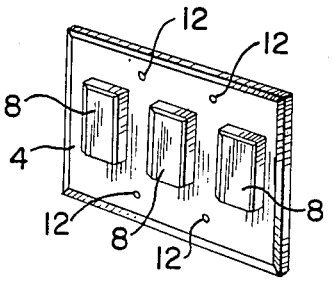
FIG. 8 is a perspective view of the assembled switch plate of the present invention having multiple actuators.

As best seen in FIG. 2, the sliding switch plate 2 of the present invention is comprised of a facing plate 4, an actuator back plate 6 and an actuation element 8. Multiple toggle switches 18 are provided for with a facing plate 4 having the correct number of openings 14, actuator back plates 6 and actuator elements 8 corresponding to the number of switches 18 (see FIG. 8).

The facing plate 4, or switch plate member is sized essentially to, or greater than the size of a conventional wall opening corresponding to a standard wall plate, where the face plate 4 can be of any size capable of covering the wall opening and any shape as dictated by design. Regardless of size or shape, the face plate 4 is provided with the conventional wall mounting holes 10 which align with the threaded receptacles found associated with all toggle switches to receive conventional mounting screws 12. In practice the threaded mounting screws 12 are vertically aligned and spaced apart about two inches. The facing plate 4 is also provided with an opening 14 through which which a conventional toggle switch actuator 18 can extend. However, in the present invention the face plate opening 14 must have a vertical dimension sufficient to allow vertical throw of the toggle switch actuator 18, as well as screwdriver access to mount the actuator element 8 on the back plate 6 (see FIG. 4).

As shown in FIG. 2, the facing plate 4 is also provided with four pins 16, that are vertically and horizontally aligned to form essentially a square. Multiple toggle face plates 4 have four pins 16 for each actuator back plate 6 and actuator 8. The location of the pins 16 is dictated by the desired relationship of the actuator element 8 to the toggle switch actuator 18. Each pin 16 is provided with an assembly of two spaced apart washers 20*a* and 20*b* having adhesive surfaces to facilitate travel of the actuator back plate 6 on the pins 16 (see FIG. 6). In practice TEFLON washers have been found to serve well in this particular application.

Figure 5:
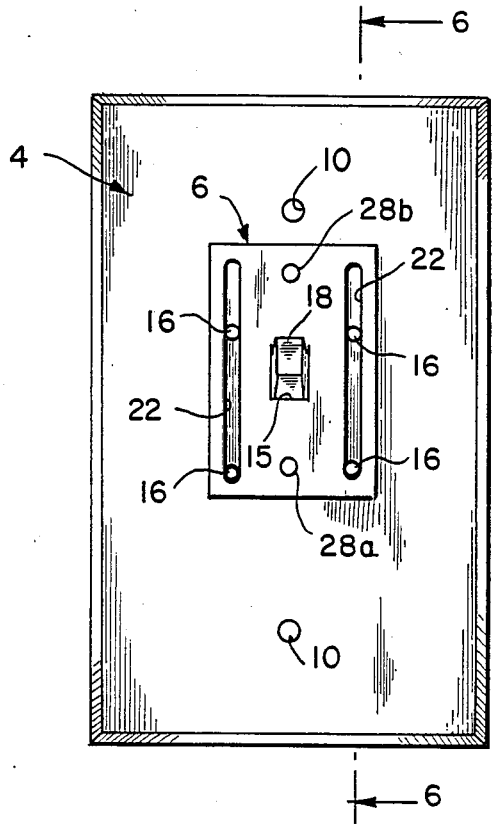
FIG. 5 is a front elevational view of the present invention with the attached actuator backing plate.
Figure 7:
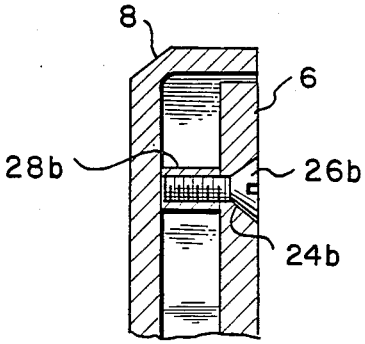
FIG. 7 is a partial side sectional view of the actuator element attached to the actuator back plate through line 4—4 of FIG. 1.
Figure 6:
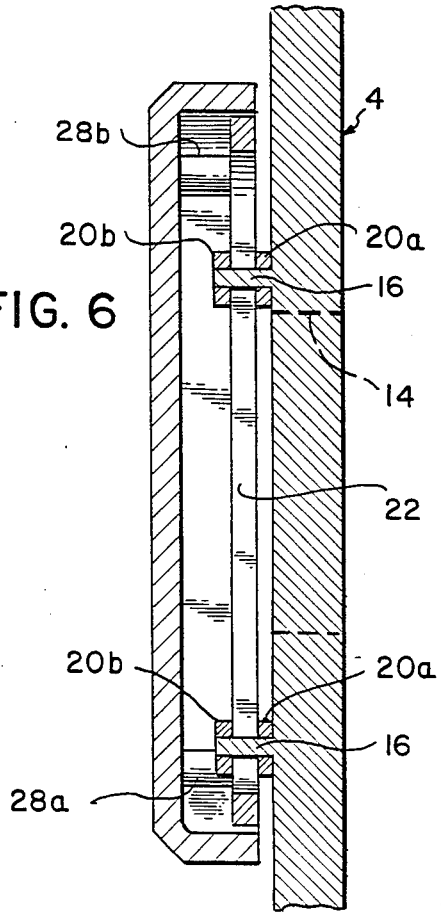
FIG. 6 is a partial side sectional view of the present invention through line 6—6 of FIG. 5.

As best seen in FIGS. 5 and 6 the actuator back plate 6 is sized to accommodate two parallel vertical slots 22, means to receive and actuate the toggle switch 18 and means to mount the actuator element 8. The slots 22 are of such a length that movement from the top of the slot 22 in contact with the top pin 16 to the bottom of the slot 22 with the bottom pin 16 allows actuation of the toggle switch 18 from the off to the on position (see FIG. 5). The slots 22 are slightly wider than the width of the pins 16, but narrower than the washers 20*a* and 20*b*. The slots 22 are located one on each side of an opening 15, to receive and actuate the toggle switch 18, and arranged to mount the actuator back plate 6 on the pins 16. Each set of washers 20*a* and 20*b* serve respectively as front and back bearing members for allowing the actuator back plate 6 to move up and down, thereby actuating the toggle switch 18 through contact with the edges of the actuator opening 15 (see FIG. 4).

As seen in FIGS. 2, 3, 5 and 7, holes 24*a* and 24*b* are provided in the actuator back plate 6 to enable conventional screws 26 to mount the actuator element 8 on the actuator back plate 6.

The actuator element 8 (as seen in FIGS. 2, 3, 4 and 6) can take virtually any shape and is intended to have a decorative configuration. The actuator element 8 is provided with threaded bushings 28*a* and 28*b* spaced apart a distance to be aligned with the holes 24*a* and 24*b* in the actuator pack plate 6 (see FIG. 3). A recess 30 is provided in the surface of the actuator element 8 abutting the actuator back plate 6 which recess 30 receives the conventional toggle switch actuator 18. The recess 30 is sized to bear against the toggle switch actuator 18 and afford vertical movement of the toggle switch actuator 18 between the on and off position (See FIG. 4).

The composite toggle switch plate 2 is assembled, as demonstrated in FIG. 2, by forming the switch plate 4 with the pins 16 extending from the front surface of the switch plate 4. The rear washers 20*a* are then fixed on the pins 16 and the actuator back plate 6 is mounted on the pins 16 which extend through the slots 22. The front washers 20*b* are then fixed on the pins 16 to retain the actuator back plate 6 on the switch plate 4. Completion of the toggle switch plate 2 occurs by sliding the actuator back plate 6 to the fully elevated position to bring the bottom hole 24*a* into the opening 14 (see FIG. 4). The screw 26*a* is then passed through the bottom hole 24*a* on the back plate 6 and screwed into the bottom threaded bushing 28*a* on the actuator element 8. The actuator back plate 6 is then slid to the fully depressed position to bring the top hole 24*b* into the opening 14. Screw 26*b* is passed through the hole 24*b* on the back plate 6 and screwed into the threaded bushing 28*b* on the actuator element 8 (see FIG. 3).

As seen in the drawings the size of the opening 14 in the back plate 4, the size of the recess 30 in the actuator element 8 and the relative location of the bottom and top holes 24*a* and 24*b* are significant. Recess 30 in the actuator element 8 must have a depth which extends beyond the extreme outward position of a conventional toggle switch actuator 18. The location of the actuator element mounting screws 26*a* and 26*b* can only be separated by the length of the opening 14 in the switch plate member 4 and travel distance allowed by the slots 22 and pins 16.

The location and number of the pins 16, as well as the number and size of the actuator elements 8 and back plates 6, will depend on the number of toggle switches 18 serviced by the face plate 2 when the invention is employed to control multiple circuits.

I claim:

1. A sliding switch cover assembly comprised of a switch plate member, a toggle actuator element comprised of an actuator back plate having front and back surfaces, means to connect an actuator element to the actuator back plate and means to bear against a conventional toggle switch actuator, movable to an on and off position, to move the conventional toggle switch actuator to an on and off position and means to mount the toggle actuator element for sliding movement on the switch plate member comprising two sets of vertically aligned pins extending from the switch plate member, vertical slots in the toggle actuator element having edges and being in alignment with the two sets of vertically aligned pins, and means to retain the veritcal slots on the two sets of vertically aligned pins for sliding movement of the toggle actuator element on the pins.

2. A sliding switch cover as in claim 1 wherein the toggle actuator element further comprises an actuator element having threaded bushings and an actuator back plate having screw holes located in relation to the threaded bushings of the actuator element wherein the means to connect the actuator element to the actuator back plate comprises screws which pass through the screw holes and thread into said threaded bushings.

3. A sliding switch cover as in claim 2 wherein the screw holes on the actuator back plate comprise a top screw hole and a bottom screw hole and the switch plate member comprises an opening for the conventional toggle switch having a top and a bottom and a vertical center line wherein the screw holes on the actuator back plate are vertically aligned with the vertical center line of the opening for the conventional toggle switch in the switch plate member and the bottom screw hole aligns with the bottom of the opening for the conventional toggle switch in the switch plate member when the actuator back plate is in a fully elevated position and the top hole aligns with the top of the opening for the conventional toggle switch in the switch plate member when the actuator back plate is in a fully depressed position.

4. A sliding switch cover as claimed in claim 1 wherein the means to retain the vertical slots on the two sets of vertically aligned pins is comprised of a front and back washer of abhesive material arranged to bear against the respective front and back surfaces of the actuator back plate along the edges of the vertical slots.

5. A sliding switch cover as claimed in claim 1 wherein multiple actuator elements are mounted on a face plate designed for use with multiple toggle switches.

* * * * *